United States Patent [19]

DeForrest, Sr., William

[11] Patent Number: 4,879,889

[45] Date of Patent: Nov. 14, 1989

[54] SHACKLE PROTECTOR

[76] Inventor: DeForrest, Sr., William, 1825 Via Burton, Anaheim, Calif. 92806

[21] Appl. No.: 101,685

[22] Filed: Sep. 28, 1987

Related U.S. Application Data

[63] Continuation-in-part of Ser. No. 79,346, Jul. 30, 1987, Pat. No. 4,852,920.

[51] Int. Cl.[4] ..... E05B 67/38

[52] U.S. Cl. ..... 70/56; 292/281

[58] Field of Search ..... 70/54–56, 70/2, 462; 292/244, 281, 205

[56] References Cited

U.S. PATENT DOCUMENTS

| | | | |
|---|---|---|---|
| 160,723 | 3/1875 | Smith et al. | 292/281 |
| 386,188 | 7/1888 | Davy | 292/285 |
| 1,319,498 | 10/1919 | Wegener | 292/281 |
| 1,898,391 | 2/1933 | Pressentin | 292/285 |
| 2,067,255 | 1/1937 | Bittorf | 292/281 |
| 2,584,575 | 2/1952 | Goldwasser | 292/205 X |
| 3,606,423 | 9/1971 | McCarthy | 70/55 X |
| 3,718,014 | 2/1973 | Delgadillo | 70/56 |
| 3,800,570 | 4/1974 | Kaplan | 70/54 X |
| 3,858,923 | 1/1975 | Bunn | 292/281 |
| 4,033,155 | 7/1977 | DeLucia | 70/56 |
| 4,106,315 | 8/1978 | Dohanyos | 70/56 |
| 4,141,232 | 2/1979 | Kelly | 70/54 |
| 4,286,814 | 9/1981 | Harrington et al. | 292/281 |
| 4,380,160 | 4/1983 | Hoffman | 70/56 X |
| 4,419,872 | 12/1983 | Plifka | 70/18 |
| 4,506,528 | 3/1985 | Eberly | 70/54 X |

FOREIGN PATENT DOCUMENTS

| | | | |
|---|---|---|---|
| 338405 | 6/1921 | Fed. Rep. of Germany | 70/55 |
| 413366 | 4/1946 | Italy | 70/55 |

*Primary Examiner*—Lloyd A. Gall

*Attorney, Agent, or Firm*—Herb Boswell

[57] ABSTRACT

A shackle protector for use in protecting the shackle of a padlock which is utilized to lock a hasp or other structure has a first and a second plate which are spaced apart are connected together in a co-planar relationship by a first connecting wall and a portion of a further connecting wall. A first slot is located in the first plate and a second slot is located in the second plate with the first and second slots aligned with one another such that the eye of a hasp or other type hardware can be passed through the slots. The shackle protector is positioned over the eye of the hasp by inserting the eye of the hasp through at least one of the first or second slots. The shackle of a lock is then passed in between the plates of the shackle protector and through the eye of the hasp. The lock is then locked. With the shackle protector so positioned, the shackle of the lock is securely protected between the first and the second plates of the shackle protector and the shackle protector is maintained on the eye of the hasp by the padlock shackle.

5 Claims, 1 Drawing Sheet

SHACKLE PROTECTOR

CROSS REFERENCE TO RELATED APPLICATIONS

This application is a continuation in part of my copending application Ser. No. 079,346 filed July 30, 1987 now U.S. Pat. No. 4,852,920 and entitled Self Protecting Hasp, the entire disclosure of which is herein incorporated by reference.

BACKGROUND OF THE INVENTION

This invention is directed to a shackle protector for protection of a padlock shackle when the padlock is utilized to lock a hasp or other similar type hardware which utilizes an eye or the like on which the padlock locks.

Hasps are highly utilitarian structures for connecting and locking two elements together such as locking a gate, a door, a cupboard, a drawer or the like. The common hasp has two main parts. The first part constitutes the latch portion. It is made up of a hinge plate which is hinged to a flap. The hinge plate has appropriate openings in it allowing it to be attached to a structure via screws, bolts or the like. The flap includes a slot.

The second portion of the common hasp is an "eye." This is sometimes referred to as a swivel or a staple. For the purposes of this specification it will be referred to as an eye. The eye includes an eye plate which also has appropriate openings for attachment of this plate to the other portion of the structure which is to be secured via the hasp.

The hinge portion is located with respect to the flap such that the flap folds over the screw heads or the like which are utilized to connect the components to a structure. The slot fits over the eye with the eye protruding through the slot. When the slot fits over the eye the flap also covers the screw heads or the like which are utilized to connect the eye plate. The shackle of a padlock can then be passed through the eye and the padlock locked. This fixes the flap to the eye such that the two components to which the hasp is attached are locked together.

In a modification of the above structure, the eye is constructed as a swivel allowing it to be rotated on the eye plate or swivel plate. It is lined up with the slot when the flap is first attached to the eye and then it is rotated 90° and thus serves as a latch to hold the flap to the eye. A lock then can be passed through the swivel to lock the structure.

When locked with a padlock, in both of the above embodiments of common hasps, an unauthorized person cannot remove the hasp from the structure which it is attached to because the flap covers the screw heads or bolt heads utilized to attach both the latch and the eye to the structure. However, the shackle of a padlock used to lock the hasp is exposed and an unauthorized person can use a pair of bolt cutters and simply snip the padlock shackle. This allows for easy removal of the padlock from the hasp followed by opening of the hasp to gain access to the structure which was being secured with the hasp and padlock.

In order to increase the security of a hasp, measures have been taken to better conceal the screw heads, bolt heads or the like utilized to connect the components of the hasp to a structure. Further, the components of the hasp have been case hardened such that they cannot be bent or pried loose from the structure on which the hasp is attached. While both of these expedients certainly help to better secure the hasp to the structure, they still leave the combination of the hasp and padlock exposed to the use of bolt cutters to sever the padlock shackle. Thus, irrespective of whatever expedients were taken to strengthen the hasp or the mounting of a hasp to the structure the combination of the hasp and padlock heretofore was always susceptible to unauthorized entry into the structure because of the exposure of the padlock shackle.

BRIEF DESCRIPTION OF THE INVENTION

In view of the above it is a broad object of this invention to provide for a shackle protector which is utilized in combination with a padlock and a hasp or other similar type structure which has an eye or the like. The shackle protector is used to protect the shackle of the padlock against severing of the shackle by bolt cutters, hacksaws and the like. It is a further object of this invention to provide a shackle protector which can be utilized with a variety of padlocks as well as a variety of hasps or other type structures and which are easily and conveniently manufactured and thus are economical to the consumer.

These and other objects as will become evident from the remainder of this specification are achieved in a shackle protector which includes a first plate and a second plate and connecting means which attaches the first plate and the second plate together in a fixed parallel-planar relationship. The connecting means attaches the first and second plates such that they are spaced apart from one another at least a distance greater than the diameter of a padlock shackle to allow for positioning of the shackle between the first and second plates. A first slot means for containing the eye of a hasp or other structure is located in the first plate and a second slot means also for containing the eye of a hasp or other structure is located in the second plate. The shackle protector is positioned over the eye of the hasp or other structure by inserting the eye through at least one of the first or the second slot means and then the shackle protector is secured to the eye of the hasp while concurrently protecting the padlock shackle by positioning the padlock shackle between the first and second plate means with the padlock shackle passing through the eye of the hasp or other structure.

The first and second slot means can be positioned in the first and second plates respectively such that they align with one another whereby when the shackle protector is positioned over the eye of the hasp or other similar type structure the eye of the hasp passes through one of the first or the second slot means and at least partially through the other of the first and the second slot means. The first and second slot means can be constructed as elongated openings or slots which are of a size that is slightly greater than the size of the eye of the hasp. When so constructed the eye of the hasp passes through these elongated openings or slots to position the shackle protector on the eye of the hasp.

In a further embodiment of the invention each of the openings in the plate include first and second elongated intersecting slots which are positioned with respect to one another such that together they make a symmetrical cross shaped or "+" shaped opening in the respective plates. This allows for positioning of the shackle protector on either vertical or horizontally oriented eyes with the padlock draping downwardly from the eye while still maintaining the shackle of the padlock securely protected within the shackle protector of the invention.

The first and second plates can be shaped as quadrilaterals with the wall means comprising at least one wall joining one of the edges of the first and second plates. Preferably a further wall joins at least a portion of a further of the edges of each of the first and the second plates such that the first and second plates are joined together along at least portions of edges which are perpendicular to one another.

BRIEF DESCRIPTION OF THE DRAWINGS

This invention will be better understood when taken in conjunction with the drawings wherein.

This invention utilizes certain principles and/or concepts as are set forth in the claims appended hereto. Those skilled in the locksmithing and manufacturing arts will realize that these principles and/or concepts are capable of being utilized in a variety of embodiments which may differ from the embodiments utilized for illustrative purposes herein. For this reason this invention is not to be construed as being limited solely to the illustrative embodiments but should only be construed in view of the claims.

DETAILED DESCRIPTION

Figure 1:
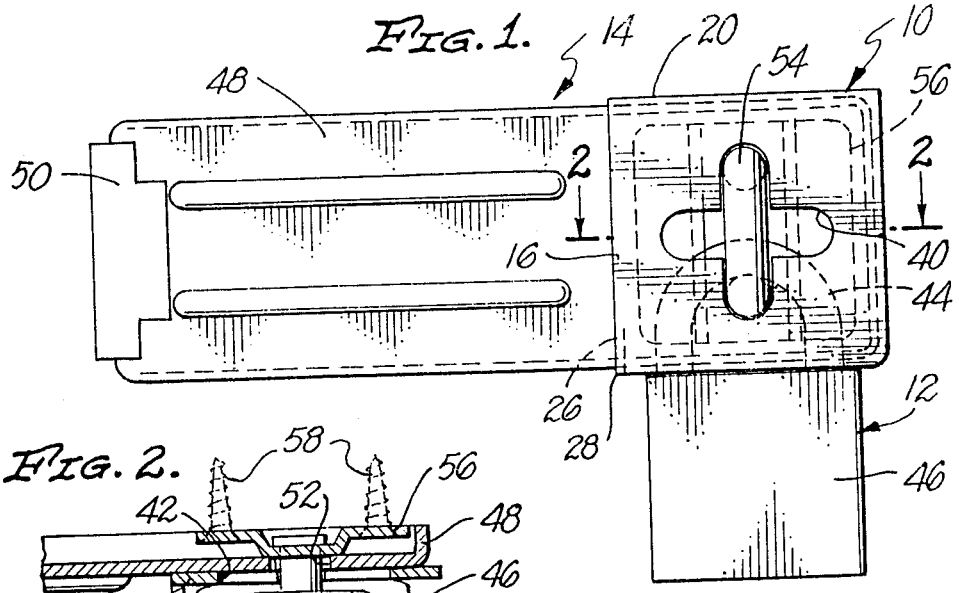
FIG. 1 is a front elevational view of the shackle protector of the invention utilized in conjunction with a common hasp and padlock.

In FIG. 1 a shackle protector 10 of the invention is utilized in conjunction with a common padlock 12 and a common hasp 14. Further, the shackle protector 10 is seen isolated in FIG. 3 from the padlock 12 and the hasp 14. Prior to discussing the interaction of the shackle protector 10 with the padlock 12 and hasp 14, its individual components will be described in reference with FIG. 3.

The shackle protector 10 has a first plate 16 and a second plate 18 which are connected together by a connecting wall 20 to form an integral structure. In forming the shackle protector 10 the first plate 16, the second plate 18 and the connecting wall 20 can be formed from a single component and appropriately formed utilizing a stamping die or the like.

Figure 3:
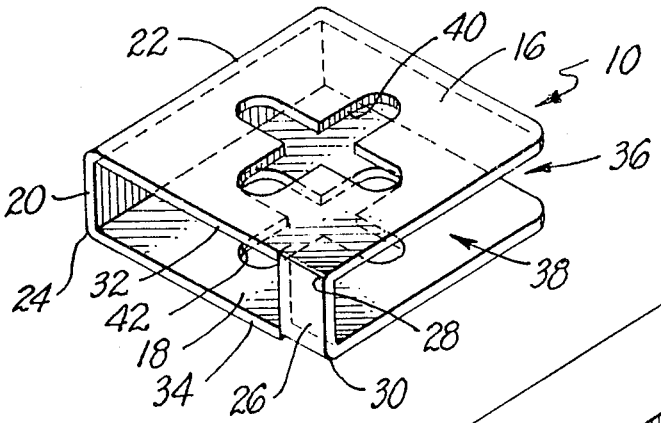
FIG. 3 is an isometric view of the shackle protector of FIG. 1.

The connecting wall 20 extends completely along an edge 22 on first plate 16 and a like edge 24 on the second plate 18. As can be seen in FIG. 3 the shackle protector 10 utilized for illustrative purposes of this invention is formed such that the first and second plates 16 and 18 are formed as squares or quadrilaterals. This allows the shackle protector 10 to be utilized for both horizontally or vertically oriented hasp eyes.

The first plate 16 and the second plate 18 are further joined by a further connecting wall 26. The wall 26 is placed adjacent to a corner 28 on the plate 16 and a like corner 30 on the plate 18. It extends along an edge 32 and an edge 34 on the respective plates 16 and 18 which are perpendicular to the edges 22 and 24. As opposed to the wall 20 the wall 26 only extends along a portion of the edges 32 and 34.

In forming the shackle protector 10 the wall 26 can be added as a separate piece by welding it or the like to the plates 16 and 18 along the edges 32 and 34. Alternately the shackle protector 10 could be formed as a die cast unit with the wall 26 integrally formed with the remainder of the components of the shackle protector 10 during the casting operation.

As so formed the shackle protector 10 includes two further opening edges, edge 36 and edge 38. Depending upon the orientation of the eye of the hasp or other device on which the shackle protector is utilized, one or the other of the open edges 36 or 38 will be oriented downwardly and allow for downward orientation of a respective padlock which is utilized to lock the respective hasp or other closure device.

The two walls 20 and 26 connecting between the plates 16 and 18 serve to hold the plates 16 and 18 in a spaced parallel-planar relationship and also serve to maintain these plates in this relationship. Preferredly by utilizing the second wall 26 in conjunction with the first wall 20, the two plates 16 and 18 resist pring apart from one another. The presence of the two walls and particularly the presence of the further wall 26 at the corners 28 and 30 away from the wall 20 assists in preventing prying open of the plates 16 and 18 away from one another.

Both the plates 16 and 18 include a "+" shaped or symmetrical cross shaped opening identified by the numeral 40 in plate 16 and the numeral 42 in plate 18. The openings 40 and 42 are aligned one on top of the other such that they are directly over one another and something can be passed through one of the openings in one of the plates, as for instance, upward through the opening 42 in plate 18 and then can further be passed through the other of the openings in the other plate, as for instance through the opening 40 in the plate 16. This allows for positioning of the shackle protector 10 over an eye of a hasp or other type structure and allows the eye to pass through both of the plates.

As is evident in FIG. 3 the "+" shaped openings 40 and 42 are oriented with respect to the wall 20 such that one leg, not separately identified numbered, of the openings 40 and 42 is parallel to the wall 20 and the other leg also not separately identified or numbered is perpendicular to the wall 20. This allows for convenient use of the shackle protector 10 on both horizontally and vertically hasp eyes or other type structures.

Figure 2:
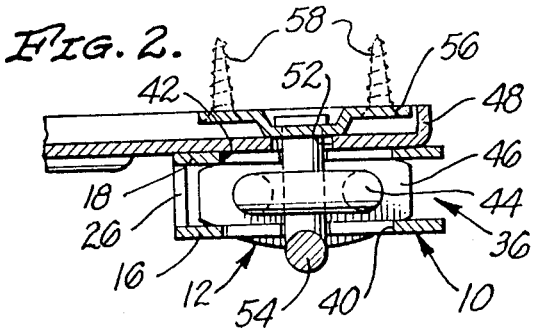
FIG. 2 is a top plan view in partial section taken along the line 2—2 of FIG. 1.

Referring now back to FIGS. 1 and 2, the shackle protector 10 is being utilized in conjunction with a hasp 14 which is being locked by a padlock 12. The padlock 12 includes an appropriate shackle 44. As shown in FIG. 1 the padlock 12 is locked with the ends of the shackle 44 securely retained within the body 46 of the padlock 12.

The hasp 14 is a common type hasp having a latch portion 48 which is appropriately hinged to a hinge portion 50. The hinge portion 50 is used to attach the latch portion 48 to a structure as is common for a common hasp. For brevity of the figures and since the hasp 14 is a common hasp, details of how the hinge portion 50 is attached to a structure is not shown in the drawings.

The latch 50 includes a slot 52 formed therein. The slot 52 is sized to fit over an eye 54. As can be seen in FIG. 2 the eye 54 attaches to an eye plate 56 which is affixed to a structure via screws collectively identified by the numeral 58. The hinge portion 50 would be attached to the structure in a very similar manner. The eye 54 extends outwardly from the eye plate 50 and when the latch 48 is passed over the eye 54 such that the eye 54 fits through the slot 52 in the latch 48 the hasp 14 is ready to be secured via the padlock.

Normally, without the use of the shackle protector 10 of the invention, the shackle 44 of the padlock 12 would simply be passed through the eye 54 to lock the eye 54 to the latch 48; however, after so attaching the lock to the hasp, the lock shackle could easily be cut with bolt cutters or a hack saw.

In use with the shackle protector 10, prior to attaching the padlock 12 to the hasp 14 the shackle protector 10 is slid over the eye 54 such that the eye 54 passes through the slots 40 and 42. The lock 12 is now attached to the eye 54 with the lock shackle 44 protectored within the shackle protected 10.

As is seen in FIGS. 1 and 2, the shackle protector 10 has been located on the eye 54 by first passing the eye 54 through the opening 42 and then partly through the opening 40. Further, as can be seen in both FIGS. 1 and 2 the connecting wall 20 is located at the top with the further connecting wall 26 oriented to the left hand side. This allows for insertion of the shackle 44 of the lock 12 through the open edge 36 to pass a free end of the shackle 44 through the eye 54. When the shackle 44 is then locked to the body 46 of the lock 12, the ends of the shackle 44 pass through the open edge 38 positioning the body 46 of the padlock 12 below the shackle protector 10 and the hasp 14.

If, in fact, the hasp 14 was being utilized such that its latch portion 48 was oriented to the right of the eye 54 instead of to the left of the eye 54 as seen in FIGS. 1 and 2, the shackle protector 10 would be reversed such that the further connecting wall 26 would be located on the right hand side. Thus the shackle protector 10 would be located on the eye 54 by first passing the opening 40 over the eye 54 and then positioning the eye 54 partly through the opening 42. This would allow for passing of the padlock shackle 44 from left to right through the opening 46 and still allow for dangling or hanging down of the padlock 12 through the other open edge 38 when the padlock 12 was locked.

As is seen in FIGS. 1 and 2, the lobes of the openings 40 and 42 which are utilized with respect to the eye 54 are those which run from the wall 20 toward the opening 38. If, in fact, a hasp is used which had an eye which was horizontally oriented and not vertically oriented as is the eye 54 seen in FIGS. 1 and 2, the other two lobes of the openings 40 and 42 would be utilized, that is the lobes which run from the edges 32 and 34 toward the open edge 36. It is thus evident that the cross or "+" shape of the openings 40 and 42 allow the shackle protector 10 to be utilized on both horizontally and vertically oriented eyes of hasps or other structures.

Figure 4:
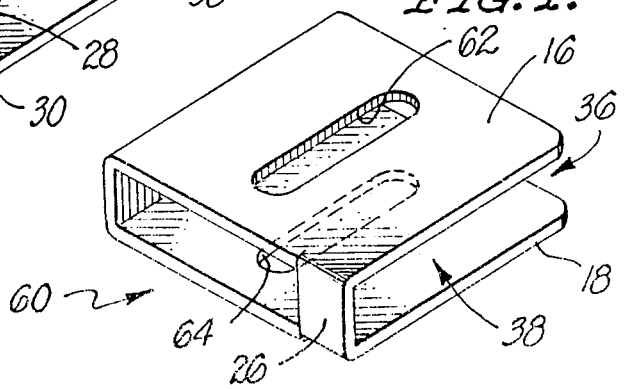
FIG. 4 is an isometric view of a further shackle protector of the invention.

FIG. 4 shows a further embodiment of the invention wherein a shackle protector 60 is illustrated. With the exception of the shape of the openings the shackle protector 60 is identical to the shackle protector 10 and as such like numerals will be utilized to identify like parts.

In the shackle protector 60, the first plate 16 and the second plate 18 each include an elongated slot, slots 62 and 64 respectively. When utilized with an eye such as the eye 54 which is horizontally oriented, that is it would be rotated 90° with respect to that seen in FIG. 1, the shackle protector 60 would be positioned exactly as per the positioning described for the shackle protector 10 above. That is for a left hand extending hasp it would be positioned with the connecting wall 26 in the lower left hand corner and with a right hand extending hasp with the connecting wall 26 in the lower right hand corner.

When the shackle protector 60 is utilized with a vertically oriented eye on a left hand extending hasp, the shackle protector 60 would be rotated 180° in first one direction and then 180° in a perpendicular direction such that the connecting wall 26 would be in the upper right hand corner. This would thus position the slots 62 and 64 in a vertical orientation with the open edge 38 to the right and the open edge 36 downwardly. This would allow for positioning of a shackle 44 of a lock 12 through the open edge 38 in dangling of the lock downwardly through the open edge 38.

For a right hand extending hasp, the shackle protector 60 would then be rotated 180° to position the further connecting wall 26 at the upper right hand corner along the top edge. This corresponds to rotating the shackle protector 60 as seen in FIG. 4 90° clockwise from the position seen in FIG. 4. Thus, the open edge 38 would be open to the left and the open edge 36 would be open downwardly.

While, for the purposes of illustration, the shackle protectors 10 and 60 are shown as being square it is, of course, evident that other shapes could be utilized. As, for instance, a round shackle protector could be formed which included a wall extending essentially around one hemisphere. This would allow for insertion of an appropriate padlock shank and downward draping of the padlock after it was locked. Such a circular shackle protector would preferredly include a symmetrical cross shape or "+" shaped opening as per the openings 40 and 42 to accomodate for both horizontally and vertically oriented eyes.

In use, once a shackle protector of the invention is located over an eye of a hasp or other similar type eye or swivel type structure, this is then locked with a padlock. The shackle of the padlock is protected from being severed, cut or the like because of the presence of the shackle protector. As is evident from the FIGS. 1 and 2, because the plates 16 and 18 are located in a fixed parallel-planar orientation with respect to one another, it is impossible to get the jaws of a bolt cutter in between the plates 16 and 18. Further, it is impossible to insert a hacksaw between these plates. This, thus protects the padlock shackle against destruction and consequently unauthorized entry into the structure for which the padlock was serving to protect.

By utilizing the further connecting wall 26 in conjunction with the first wall 20, prying of the plates 16 and 18 away from one another is inhibited. By placement of the further connecting wall 26 adjacent to the corners 28 and 30 which are distal from the wall 20, the parallel-planar relationship of the plates 16 and 18 is maintained and the overall structure of the shackle protector 10 is strengthened.

The shackle protector 10 can be made of an appropriate metallic component as, for instance, case hardened steel or the like to provide for added security of the lock shackle at minimum expense to the consumer. Both the shackle protectors 10 and 60 of the drawings can be easily formed by stamping the appropriate slots therein and bending the shackle protectors to orient the first and second plates 16 and 18 in a co-planar relationship and spaced apart by the first connecting wall 20. The further connecting wall 26 can then be added by appropriately welding it to the plates 16 and 18. Alternately, as indicated above any of the shackle protectors of the invention can be appropriately formed of an integral unit by casting or other forming techniques.

I claim:

1. In combination with a hasp having a slot for receiving a staple and a padlock having a shackle, a separate shackle protector which comprises:

a first plate, said first plate shaped as a quadrilateral;

a second plate, said second plate shaped as a quadrilateral;

a first wall joining said first and said second plates along the length of an edge of each of said first and second plates and positioning and fixedly holding said first and said second plates in a parallel-planar relationship with a hollow interior between said first and second plates;

a further wall joining at least a portion of a further edge of each of said first and said second plates, said further wall perpendicular to said first wall;

a first elongated slot of a width and a length sufficiently greater than the dimensions of said staple of said hasp to allow said staple to be inserted through said first elongated slot, said first slot located in said first plate;

a second elongated slot of a width and a length sufficiently greater than the dimensions of said staple of said hasp to allow said staple to be inserted through said second elongated slot, said second slot located in said second plate; and said shackle protector positionable over said staple of said hasp by inserting said staple of said hasp through at least one of said first or said second slots with said shackle protector secured to said staple of said hasp and protecting said padlock shackle by positioning said padlock shackle in said hollow interior between said first and said second plates with said shackle passing through said staple of said hasp.

2. The combination of claim 1 wherein:

said first and said second slots are located in said first and said second plates respectively in positions which are aligned with one another whereby said shackle protector can be positioned on said staple of said hasp with said staple of said hasp passing through one of said first and said second slots and at least partly through the other of said first and said second slots.

3. A shackle protector which comprises:

a first plate shaped as a quadrilateral;

a second plate shaped as a quadrilateral;

a wall joining at least a portion of one edge of each of said first and said second plates;

a further wall joining at least a portion of a further edge of each of said first and said second plates;

said wall and said further wall attaching and maintaining said first and said second plates together in a fixed parallel-planar shaped orientation with respect to one another wherein said first and said second plates are spaced apart from one another at least a distance greater than the diameter of a padlock shackle;

a first opening for containing an eye of a hasp, said first opening located in said first plate;

a second opening for containing an eye of a hasp, said second opening located in said second plate;

said first and said second openings each of a size sufficiently greater than the dimensions of said eye of said hasp to allow said eye to be inserted through said respective openings;

said first and said second openings each include a first and a second intersecting elongated slot, said first and said second intersecting slots oriented with respect to one another to form a symmetrical cross shaped opening in said respective plates; and said shackle protector positionable over said eye of said hasp by inserting said eye of said hasp through at least one of said first or said second openings with said shackle protector secured to said eye of said hasp and protecting said padlock shackle by positioning said padlock shackle between said first and said second plates with said shackle passing through said eye of said hasp.

4. A shackle protector which comprises:

a first plate shaped as a quadrilateral;

a second plate shaped as a quadrilateral;

a wall joining one edge of each of said first and said second plates along the length of said edge;

a further wall joining at least a portion of a further edge of each of said first and said second plates, said further wall positioned in association with a corner of each of said quadrilateral shaped first and second plates and positioned with respect to said wall joining said one edge such that said one edge is perpendicular to said further edge;

said wall and said further wall attaching and maintaining said first and said second plates together in a fixed parallel-planar spaced orientation with respect to one another wherein said first and said second plates are spaced apart from one another at least a distance greater than the diameter of a padlock shackle;

a first opening for containing an eye of a hasp, said first opening located in said first plate;

a second opening for containing an eye of a hasp, said second opening located in said second plate;

said first and said second openings each of a size sufficiently greater than the dimensions of said eye of said hasp allowing said eye to be inserted through said respective openings;

said first and said second openings each include a first and a second intersecting elongated slot, said first and said second intersecting slots oriented with respect to one another to form a symmetrical cross shaped opening in said respective plates; and said shackle protector positionable over said eye of said hasp by inserting said eye of said hasp through at least one of said first or said second openings with said shackle protector secured to said eye of said hasp and protecting said padlock shackle by positioning said padlock shackle between said first and said second plate with said shackle passing through said eye of said hasp.

5. In combination with a hasp having a slot for receiving an eye and a padlock having a shackle, a separate shackle protector which comprises:

a first plate;

a second plate;

at least one wall joining said first and said second plates and positioning and fixedly holding said first and said second plates in a parallel-planar relationship;

first slot means for containing said eye of said hasp, said first slot means located in said first plate;

second slot means for containing said eye of said hasp, said second slot means located in said second plate;

said shackle protector positionable over said eye of said hasp by inserting said eye of said hasp through at least one of said first or said second slot means with said shackle protector secured to said eye of said hasp and protecting said padlock shackle by positioning said padlock shackle between said first and said second plates with said shackle passing through said eye of said hasp;

said first slot means comprises an opening in said first plate and said second slot means comprises an opening in said second plate, said first and second openings of a size sufficiently greater than the dimensions of said eye of said hasp to allow said eye to be inserted through said respective openings; and said first and said second openings each include a first and a second intersecting elongated slot, said first and said second intersecting slots oriented with respect to one another to form a symmetrical cross shaped opening in said respective plates.

* * * * *